United States Patent [19]

Geiger

[11] 4,097,307

[45] Jun. 27, 1978

[54] FILL CONTROL FOR AN AUTOMATIC DISHWASHER

[75] Inventor: Paul B. Geiger, Piqua, Ohio

[73] Assignee: Hobart Corporation, Troy, Ohio

[21] Appl. No.: 751,684

[22] Filed: Dec. 17, 1976

[51] Int. Cl.[2] ..... B08B 3/02

[52] U.S. Cl. ..... 134/10; 134/18; 134/25 A; 134/57 D; 134/111; 134/186

[58] Field of Search ..... 134/10, 18, 25 A, 52 D, 134/58 D, 102, 103, 111, 113, 174, 176, 186

[56] References Cited

U.S. PATENT DOCUMENTS

| | | | |
|---|---|---|---|
| 2,681,658 | 6/1954 | Meeker et al. | 134/186 X |
| 3,134,386 | 5/1964 | Jenkins | 134/186 X |
| 3,702,680 | 11/1972 | Wuehler | 134/58 D X |
| 3,885,580 | 5/1975 | Cushing | 134/57 D X |

*Primary Examiner*—Richard V. Fisher

[57] ABSTRACT

The recirculating pump output is monitored as the pump is operated during each fill cycle, and the fill is terminated just when the desired pump output is reached. The output is less than the pump maximum and results from continuous aspiration of water and air into the pump inlet, thus using only the minimum liquid necessary, and automatically reducing liquid consumption during subsequent fills as the washing operation progresses. The pump inlet faces downwardly at the bottom of the dishwasher tank to control surging.

16 Claims, 26 Drawing Figures

FILL CONTROL FOR AN AUTOMATIC DISHWASHER

BACKGROUND OF THE INVENTION

This invention relates to dishwashing machines, and more particularly to a fill control for either domestic or commerical dishwashers. The control reduces water consumption and may be used to provide controlled, lower pressure dishwashing.

Dishwasher automatic fill cycles are usually governed either by elapsed time, water quantity (i.e., depth, as sensed by floats or pressure devices), or both. As is well known, these machines typically use more water than necessary. This is a deliberate precaution to ensure satisfactory operation, and is considered necessary for a number of reasons. For example, there must be assurance that at least the minimum quantity of water will be supplied if water line pressure is low. When the pressure is normal or above, this means that too much water will be supplied, even if a "constant flow" inlet valve is used.

Excess water is also provided to allow for variations in the sizes and types of loads, e.g., the larger the amount of protein (such as milk and eggs) in the food leavings on the dishes, the greater will be the tendency of the solution to foam. Foam entrains large amounts of air in the water, reducing the actual quantity of water in the dishwasher sump. The pump may then recirculate suds rather than water, causing the pump to air bind so that it fails to supply adequate pressure for washing.

Excess water is also necessary to counteract other factors which act to reduce the water supply available to the pump inlet in the dishwasher sump. For example, water may be captured in inverted dishes or glasses. Also, many dishwasher recirculating systems have a tendency to surge. A nominal amount of surging is normal, but if the water availability is low, the pump may air bind momentarily, causing a sharp increase in the subsequent intensity of the surges as the pump inlet alternately floods and empties. Excess water reduces the susceptibility of the dishwasher to these problems.

Where water and energy are plentiful and cheap, the use of such excess water is acceptable. However, with increasing costs, it becomes increasingly desirable to use only that which is necessary. Since the water is heated, this means potential savings in both water and energy. On the other hand, it is still necessary to allow for the variables mentioned above, since they can cause significant differences in the amount of water actually required from one load of dishes to the next.

Still further savings of energy and water could be realized on loads which do not require full pressure for the wash. If a lower pressure were used, less energy would be used to operate the recirculating pump. Even more desirable would be a low pressure cycle which could be effected with less water than used in a normal pressure cycle. Typical applications for low pressure cycles include washing delicate items, such as fine china; light duty, such as "rinse hold" for conditioning dishes for subsequent washing; and light duty quick washes, such as washing lightly soiled dishes and removing dust from dishes which have been stored for a while.

SUMMARY OF THE INVENTION

Briefly, the present invention provides a fill control for an automatic dishwasher which automatically admits only the minimum amount of water required for the particular type, load, and soil conditions present. Further, in dishwashing machines having multiple fill and drain cycles for each dishwashing operation, the present invention automatically adapts to the changing needs as the operation progresses. Thus, if the soil is light, only the minimum amount of water is admitted. If the food soil is heavy, additional water is admitted until an adequate amount is available to maintain the proper washing action. Then, during subsequent fill cycles as the soil is washed and drained away, less water will be needed, and less water will accordingly be admitted. Further, if lower pressure operation is desired, it can be selected and provided solely as a function of the amount of water being admitted. Only the necessary amount of water is supplied and no more.

From the above, it can be seen that the fill control for the present invention is not a function of time, although the cycle timer does set a maximum fill time. Neither is the present invention governed by the water supply pressure or the flow rate, since these are not sensitive to the soil and size variables in the dishes and food leavings. Likewise, the chemical and physical properties of the washing solution, such as alkalinity and acidity, are not monitored directly.

Rather, the present invention monitors the output developed by the recirculating pump and operates the fill valve to admit water until the desired pump output is sensed. The pump is operated throughout the fill cycle, although it does not need to be operated until the latter portion thereof. As the dishwasher tank begins to accumulate liquid in its sump, the liquid is drawn into the pump inlet, but it is also mixed with air. As additional liquid fills the dishwasher, the pump recirculates more and more water and less and less air. With reduced air binding, the output of the pump increases. When the output reaches the desired level, the pump output sensing means terminates the fill. The fill is therefore accomplished with only the minimum amount of water necessary to reach the desired output.

It may be seen that partial air binding of the pump takes place until full pressure is achieved. Therefore, low pressure operation is provided by deliberately accepting partial air binding of the recirculating pump. As has no doubt been anticipated by virtue of the present discussion, this reduction in pressure through partial air binding is effected simply by making less water available at the pump inlet, so that air is drawn in along with the water. In the past, however, operation under these conditions has normally been unstable, degenerating into heavy surging. The surging is a type of oscillation caused by flooding of the pump inlet, subsequent full pressure discharge of the water, emptying of the pump inlet, air binding, and then a return of the water to re-flood the pump inlet.

The present invention controls this surging tendency by inverting the pump inlet and opening it downwardly toward the bottom of the dishwasher tank in the vicinity of the liquid pool which is collected there. This configuration effectively blocks air entrance into the "eye" of the pump inlet. Thus, unlike upwardly facing inlets, the pump has less tendency to pull a vortex through the center of the eye which could admit air to bind the pump and trigger off the undesired surging. Rather, a small amount of air (possibly a thin annulus) is substantially continuously aspirated along the outer edge of the pump inlet so that the flow of air and water is relatively uniform and balanced to provide the pressure desired. It will be appreciated that the performance of the pump, and the pressure supplied, will thus be sensitive to the amount of water or wash liquid which is available. Small changes in the total supply can produce significant changes in the pump output. This calls for accurate control of the amount of water available, and will vary according to the factors discussed above.

The present invention is thus able to supply exactly the amount of water and pressure needed for the particular conditions at each stage of each load, and no more. Further, since water entrapment and suds development may continue over a short period, the present invention will sense a decrease in the pump output and may periodically admit more water during the fill interval controlled by the timer.

It is therefore an object of the present invention to provide a fill control for an automatic dishwasher which is responsive to the output of the recirculating pump, supplies only the water necessary to achieve the desired pump output, and automatically compensates for the condition of the dishes and food leavings at each stage of each load to supply only such water as may be needed; which permits operation at several preselected pressures, with only the minimum water necessary for each such pressure; which uses partial air binding of the recirculating pump as an integral part of a pressure controlled partial fill to limit the pump output to one or more predetermined pressures; which uses an inverted pump inlet to suppress the tendency of the recirculating system to surge during operation under partial air binding; and to accomplish the above objects and purposes in an uncomplicated, efficient, and inexpensive configuration well suited to a wide range of applications for minimizing the amount of water and energy consumed in dishwashing operations.

DESCRIPTION OF THE PREFERRED EMBODIMENT

Figure 1:
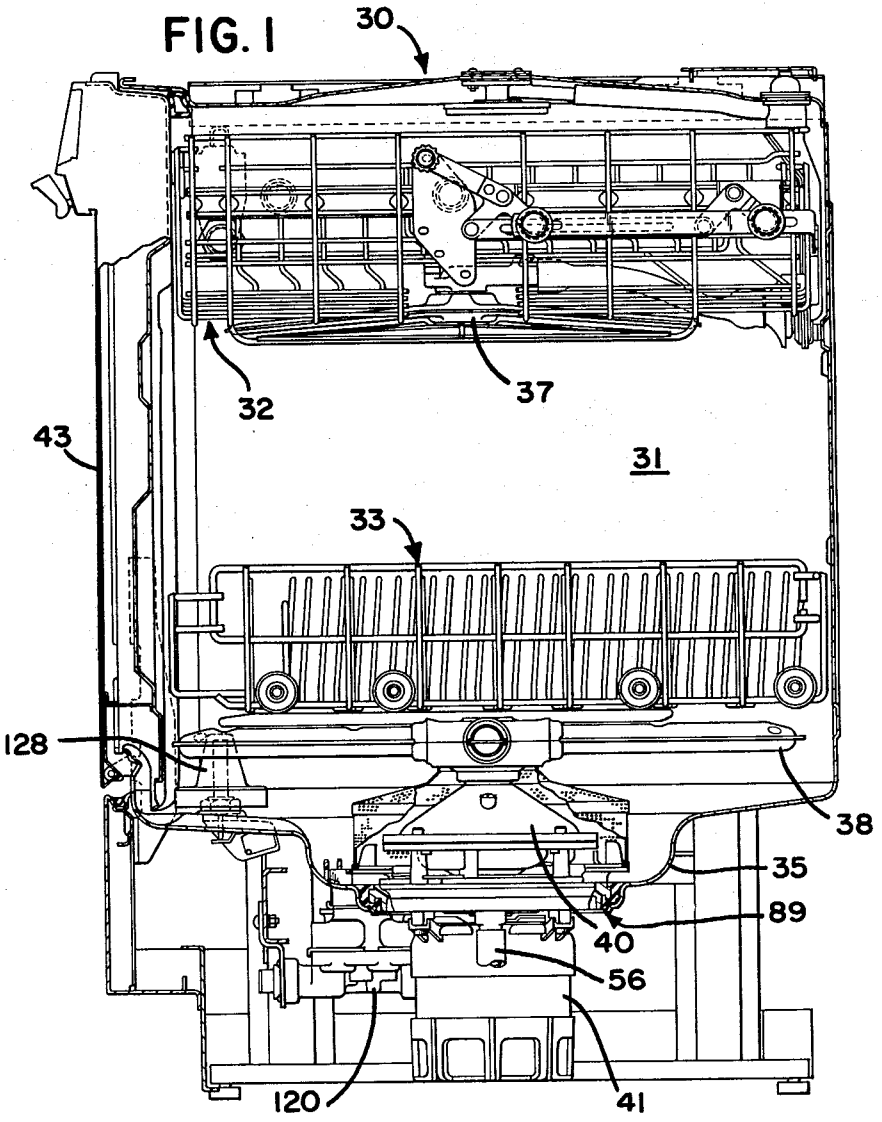
FIG. 1 is a partially broken away side cross-sectional view of a domestic dishwasher incorporating the fill control of the present invention, portions of the dishwasher having been omitted for clarity of illustration.

The dishwasher 30 illustrated in FIG. 1 may be a domestic or commerical dishwasher typically using several fill and drain cycles in the curse of washing a load of dishes. Dishwasher 30 includes a tank 31 containing upper and lower racks 32 and 33 for supporting the dishes within the tank 31. The bottom of the tank has a sump 35 for containing a pool of liquid which is recirculated into upper and lower spray arms 37 and 38 by a recirculating pump assembly 40 powered by a motor 41. Access to the interior of tank 31 is through a front door 43.

Figure 3:
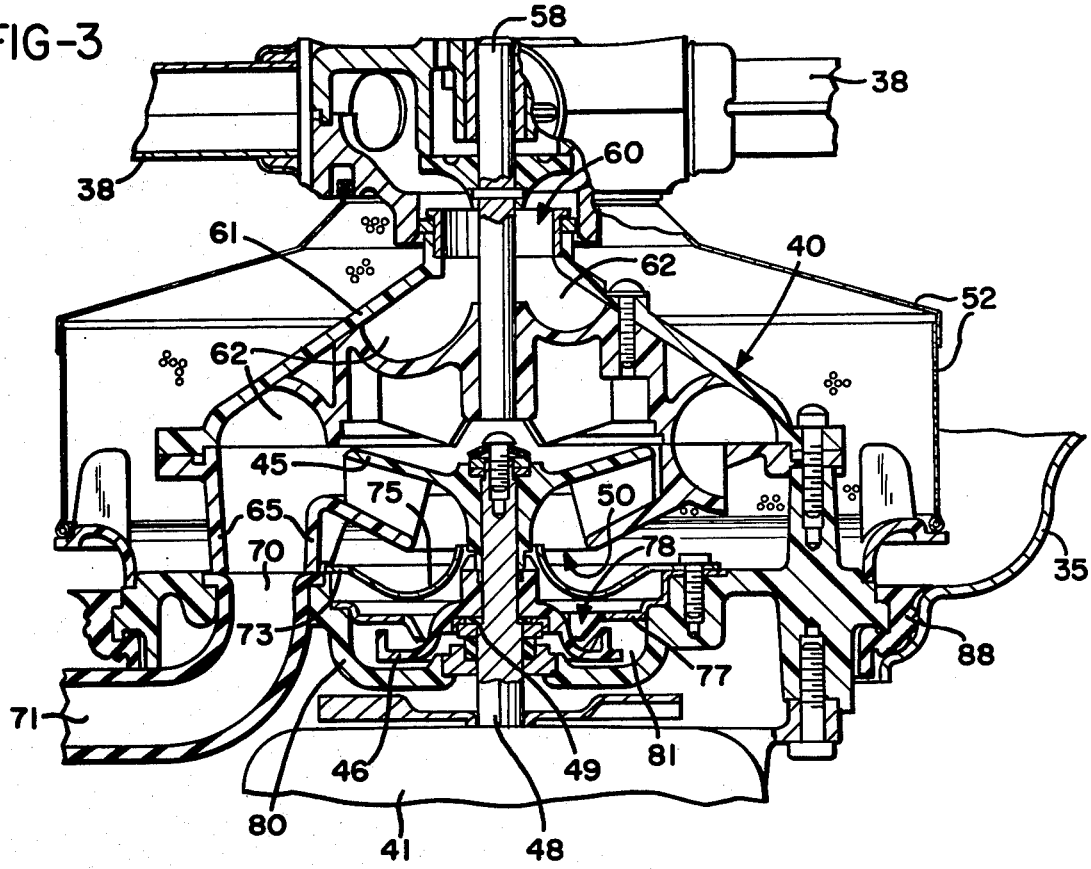
FIG. 3 is a cross-sectional view of the recirculating pump taken on line 3—3 of FIG. 11, and showing the downwardly facing inlet.

With reference to FIGS. 1 and 3, the recirculating pump assembly 40 includes an upper recirculating impeller 45 and a lower drain pump impeller 46. The recirculating impeller 45 is drivably attached to the upper end of the motor drive shaft 48. Impeller 45 is also biased downwardly against drain pump impeller 46 to engage and rotate impeller 46 as impeller 45 is rotated by the motor drive shaft 48. Impeller 46, in turn, is supported against a shoulder 49 on drive shaft 48.

Impeller 45 has a downwardly facing inlet 50 through which liquid is drawn into the pump for recirculation. Inlet 50 communicates with sump 35 through a fine mesh screen 52 which is in the liquid flow path from tank 31 to inlet 50. Screen 52 removes small particles of food and other debris before the liquid is recirculated onto the dishes within the dishwasher.

Figure 4:
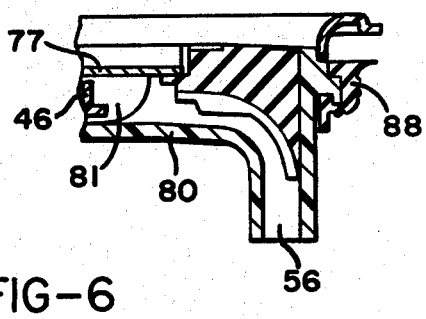
FIG. 4 is a cross-sectional view of the drain pump outlet taken on line 4—4 of FIG. 13.
Figure 5:
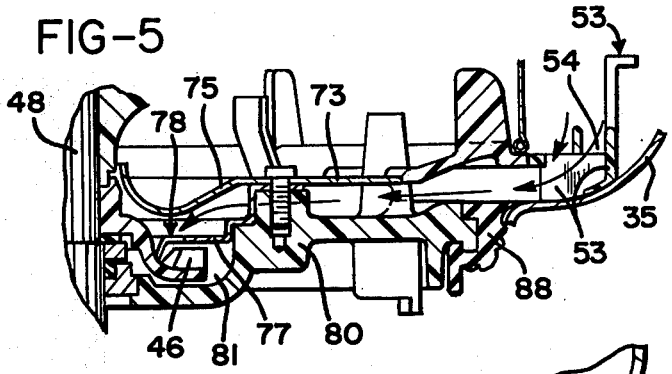
FIG. 5 is a section taken on line 5—5 of FIG. 14, showing the inlet to the drain pump through the coarse filter.
Figure 6:
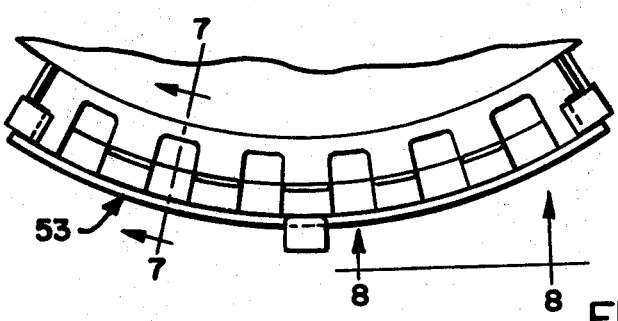
FIG. 6 is a top view of the coarse filter.

The drain pump impeller 46 receives liquid from the sump 35 through a coarse filter 53 which includes inlet 54 (FIG. 5). Coarse filter 53 permits moderately sized food particles to be pumped out by the drain pump 46 but deters large articles from entering the pump. Since the pump impeller 46 is always rotated when motor 41 is energized, a drain valve (not shown) is located in series with the outlet 56 (FIG. 4) from the drain pump to prevent liquid from being drained except as desired.

Figure 11:
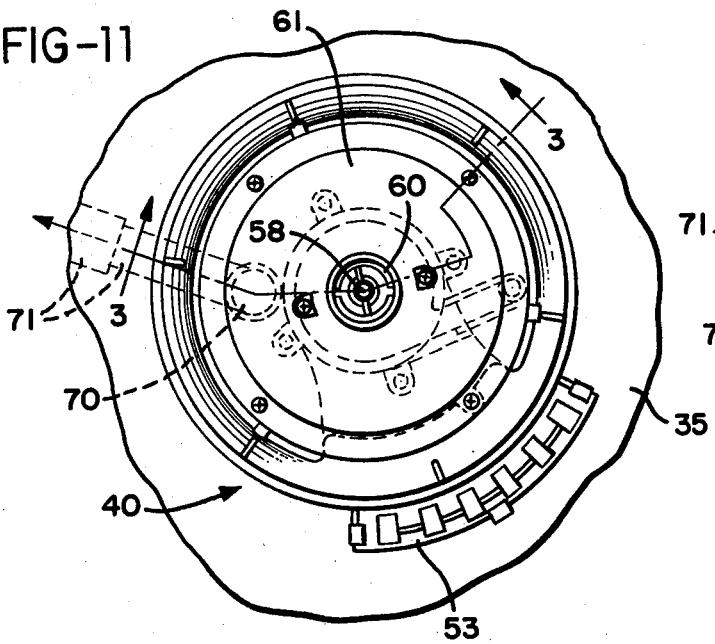
FIG. 11 is a plan view of the recirculating pump and coarse filter in position in the dishwasher, with the lower wash arms and the fine mesh screen removed.
Figure 12:
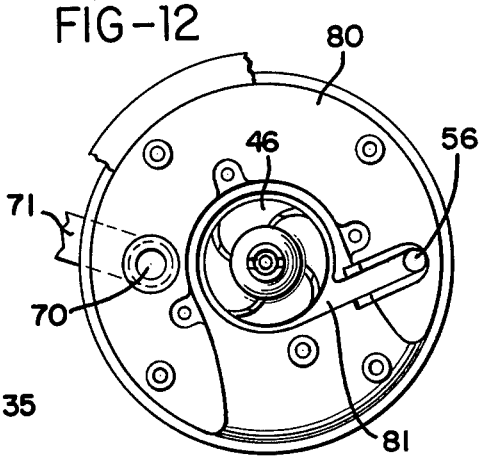
FIGS. 12–15 illustrate successive steps in the assembly of the FIG. 11 pump, FIG. 12 being the initial step.
Figure 14:
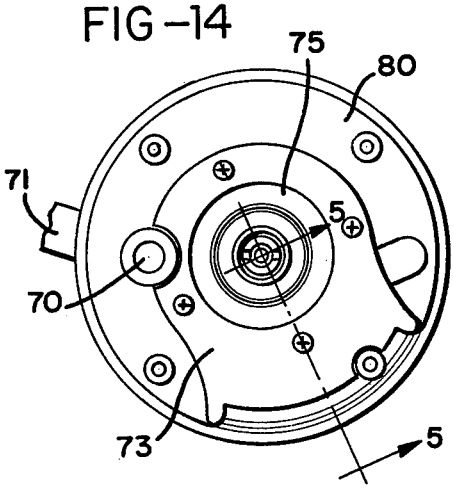
Figure 15:
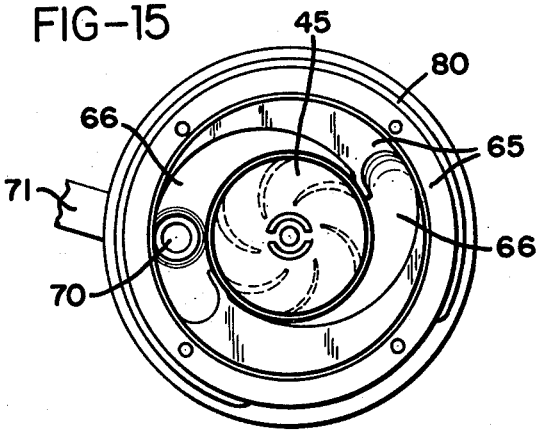
Figure 16:
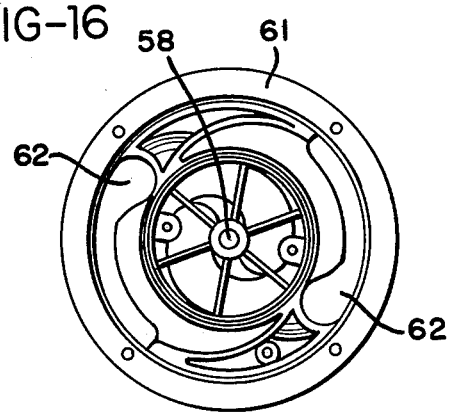
FIG. 16 is a bottom view of the top housing portion of the recirculating pump, this portion being complementary to the portions assembled in FIG. 15.

Turning now to FIGS. 11–16, the recirculating pump assembly 40 will be explained in detail so that the flow paths therethrough may be more readily understood. FIG. 11 is a plan view of the pump assembly 40 with the lower spray arm 38 removed, revealing the support shaft 58 on which the lower spray arm 38 is normally mounted for rotation. The upper outlet 60 of the recirculating pump is thus also exposed, and forms the central opening of the top housing 61 of the pump assembly 40. The top housing 61 is actually formed of two pieces which are combined to provide a pair of spiral flow paths or channels 62 (FIGS. 3 and 16) from the recirculating impeller 45 into the lower spray arm 38 through the upper outlet 60. It should be noted that FIG. 16 is an inverted view of the housing top 61.

Figure 2:
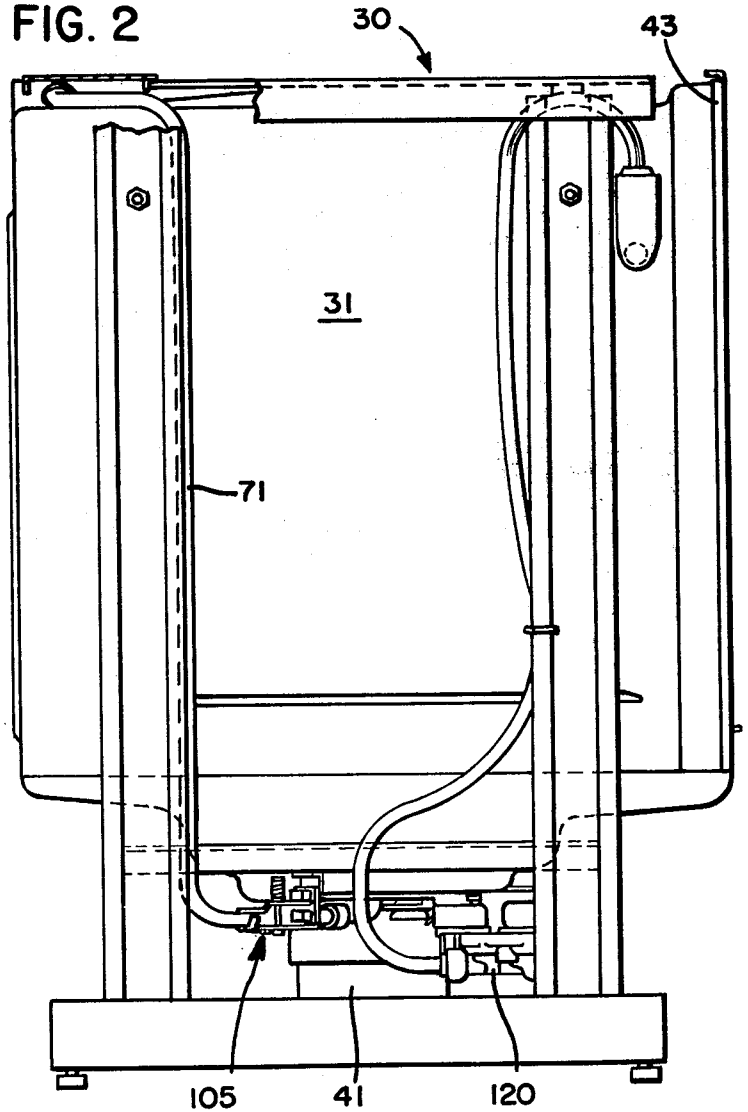
FIG. 2 is an outside view of the opposite side of the dishwasher illustrated in FIG. 1.

FIG. 15 shows the recirculating pump assembly 40 after the top housing 61 (FIG. 16) has been removed. Here an intermediate housing portion 65 of the recirculating pump assembly 40 forms two partial volutes 66 for receiving the wash liquid from the recirculating impeller 45. Volutes 66 communicate with the spiral flow path channel 62 in the top housing 61, and also with a lower outlet channel 70 which is connected to the upper spray arm 37 by a recirculating liquid conduit 71 (FIG. 2). With reference to FIG. 3, the intermediate housing portion 65 also defines the recirculating pump inlet 50, and serves to divide the flow coming to the recirculating impeller 45 from the flow discharging therefrom to the upper and lower pump outlets 60 and 70.

When the intermediate housing portion 65 and impeller 45 are removed from the FIG. 15 illustration, it then appears as in FIG. 14. Here a flow divider plate 73 may be seen which separates the liquid flowing to the recirculating pump inlet 50 from the liquid flowing to the drain pump impeller 46. Flow divider plate 73 has a central portion which is depressed to form an annular cup-like core 75 opposite the recirculating pump inlet 50 (see FIG. 3). The intermediate housing portion 65 and the flow divider plate 73 thus cooperate at the annular core 75 to form a somewhat dished-out flow path for the liquid just before it enters the recirculating pump inlet 50. This configuration appears to cooperate with the downwardly facing inlet to the pump to assist in suppressing surging, and to help aspirate a small, substantially continuous supply of air during partial air binding of the pump.

Figure 13:
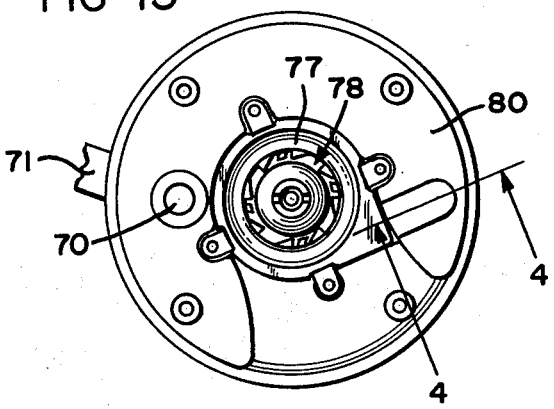

When the flow divider plate 73 is removed from the FIG. 14 assembly, the remainder looks as in FIG. 13. Here may be seen a drain pump inlet plate 77 which defines an inlet 78 for the drain pump impeller 46.

Finally, when plate 77 is removed (FIG. 12), the drain impeller 46 is seen disposed above the lower housing portion 80 of the recirculating pump assembly 40. Lower housing portion 80 defines a drain pump volute 81 communicating with the drain pump outlet 56.

Details of the coarse filter 53 appear in FIGS. 5–8 and 11. From these it may be seen that the coarse filter 53 is generally a perforated plastic member extending around a small portion of the outer circumference of the pump assembly 40, and being located just outside the drain pump in the flow path defined by the flow divider plate 73.

Figure 9:
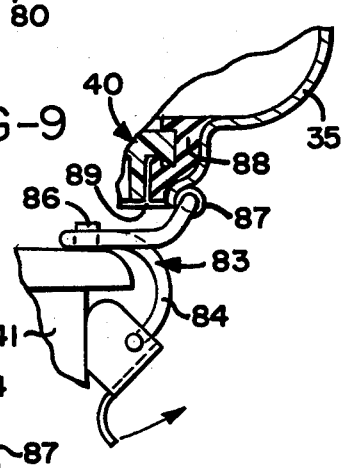
FIG. 9 is an enlarged fragmentary detail of the motor mounting clamp illustrated in FIG. 1.
Figure 7:
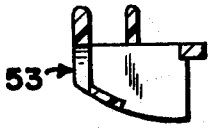
FIG. 7 is a section on line 7—7 of FIG. 6.
Figure 8:
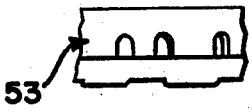
FIG. 8 is a view taken on line 8—8 of FIG. 6.
Figure 10:
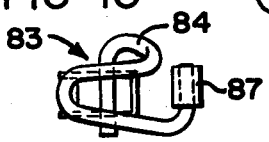
FIG. 10 is a plan view of the motor mounting clamp shown in FIG. 9.

The pump assembly 40 and motor 41 are secured in the sump 35 of the dishwasher tank 31 by pump clamps 83 shown in detail in FIGS. 9 and 10. These clamps include a loop of stiff wire 84 which is hooked over a post 86 on the motor 41 to push the motor downwardly by forcing the cushioned end 87 of the clamp 83 against the bottom of the sump 35. This forces the pump assembly 40 down firmly against a gasket 88 to seal the pump assembly into the pump assembly opening 89 in the bottom of the sump 35.

Turning now to FIGS. 17–21, there is illustrated a two-pressure fill control according to the present invention. At the start of the fill cycle, the recirculating pump motor 41 is energized. Then, as shown somewhat diagramatically in FIG. 17, the motor starting coil switch 91 (FIG. 23) is utilized to complete a circuit from the line $L_1$ to conductor 92. This assures that conductor 92 will not be energized unless the recirculating pump motor is operating.

Conductor 92 carries the power to a set of contacts 143 (FIG. 23) in timer 95. The timer acts as a cycle control which establishes a series of fill and drain periods for the dishwasher during the course of washing a load of dishes. At the start of each fill cycle the contacts 143 are closed to energize line 96 for introducing water into the dishwasher tank 31.

Line 96 goes to a manual selector switch 100, such as a pressure selector or a cycle selector, and to a lower pressure switch 104. Switch 104 is part of a pump output sensing assembly 105 for sensing the output pressure developed by the recirculating pump assembly 40 and motor 41.

The pump output sensing assembly 105 includes a section of resilient conduit 107 forming a portion of the recirculating liquid conduit 71. Section 107 is thus flexibly responsive to the pressure of the recirculating liquid therewithin.

Assembly 105 also includes upper and lower clamp portions 109 and 110 clamped about and engaging the resilient conduit section 107 for compressing it against the liquid pressure therein. Lower clamp portion 110 includes a stop 111 against which the upper clamp portion 109 is biased by a preload spring 112, which in turn is carried on a bolt 113 supported on the lower clamp portion 110. Preload spring 112 and stop 111 cooperate to establish a predetermined minimum or threshold pressure which must be applied to the resilient conduit section 107 by the liquid therein in order to pivot the upper clamp portion 109 in a resilient manner between the clamp preload spring 112 and a pivot 114. Thus, when the predetermined pressure as set by preload spring 112 is reached, the upper and lower clamp portions 109 and 110 may pivotally move apart on pivot 114 in response to expansion of the resilient conduit section 107 under liquid pressure therein.

The upper clamp portion 109 includes an extension thereon forming a trip member 115 which follows the expansion of the resilient conduit section 107 and the clamp. Trip member 115 normally bears against the switch probe of the low pressure switch 104. Switch 104 is a normally open switch which is maintained closed when the upper clamp portion 109 is on stop 111. However, when the resilient conduit section and clamp expand as the predetermined pressure is reached, trip member 115 is moved away from switch 104, permitting it to return to its normal or open position.

Figure 17:
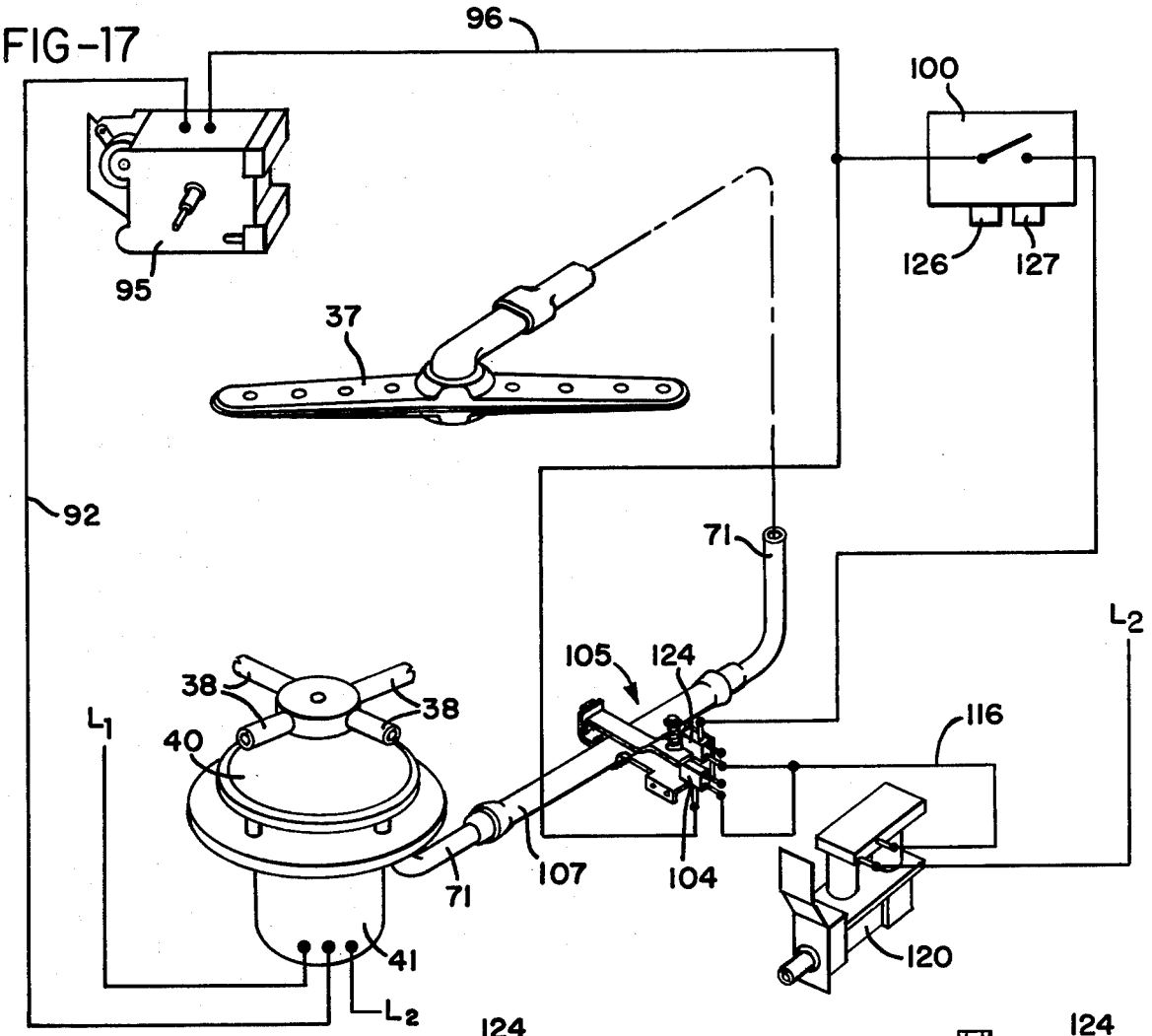
FIG. 17 is a somewhat schematic illustration of a two-pressure fill control according to the present invention.
Figure 18:
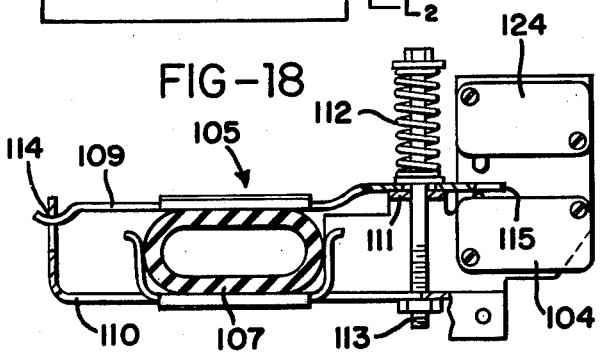
FIG. 18 is a partial cross-sectional view of the pressure sensing switch assembly illustrated in FIG. 17, and in the below normal pressure or rest state.
Figure 19:
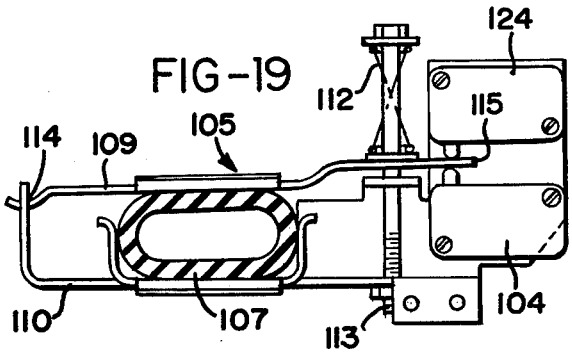
FIG. 19 illustrates the FIG. 18 switch in the position after the first predetermined pressure has been reached.
Figure 20:
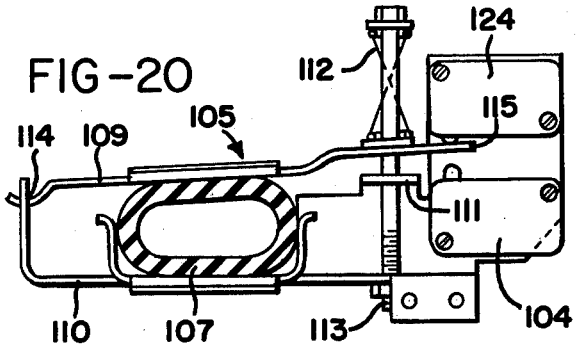
FIG. 20 illustrates the switch after a second, higher predetermined pressure has been reached.
Figure 21:
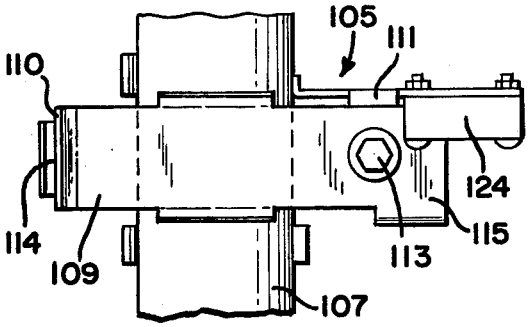
FIG. 21 is a plan view on a smaller scale of the pressure sensing switch illustrated in FIGS. 18–20.

As shown in FIG. 17, switch 104 is connected between line 96 and line 116 which leads to the fill control valve 120 for admitting water to the dishwasher. The electrical circuit is then completed through the fill valve to the other side of the line power represented by line $L_2$. Fill valve 120 is normally closed, and opens to admit water to the dishwasher 30 when electrically energized.

Thus, when motor 41 is operating and timer 95 completes the circuit to line 96, low pressure switch 104 will complete the circuit to open the fill valve 120 as long as the pump output pressure is below the predetermined amount necessary to move the trip member 115 away from the low pressure switch 104. This predetermined pump output is a reduced output caused by simultaneous aspiration of water and air into the pump inlet, and is chosen to be less than the maximum output of which the recirculating pump is capable, as discussed further herein. These circuits therefore form a fill regulating control means which is connected to operate the pump and the fill valve during each predetermined fill period as selected by the timer, in order to introduce liquid into the dishwasher while the pump is operating.

The fill regulating control circuit includes the pump output sensing assembly 105 which, during this time, will continue to operate the fill valve 120 as long as the sensed output from the pump remains below the predetermined level. This will introduce just enough water into the dishwasher to cause the recirculating pump to aspirate the proper ratio of liquid and air through inlet 50 to develop this predetermined reduced output. As soon as this output is reached, the low pressure switch 104 will be opened by trip member 115, terminating fill of water into the dishwasher through valve 120. Thus the fill regulating control means causes the recirculating pump to develop the predetermined output with only the minimum quantity of liquid needed therefor. As discussed further herein, the liquid quantity introduced from one fill period to the next will ordinarily vary during the course of washing a load of dishes. This variation in the quantity of liquid which is needed will depend on the size of the load of dishes, the nature of the food soil thereon, and other conditions (such as the presence or absence, and quantity of detergent) of the particular load of dishes in the dishwasher at the time of each particular fill period.

It will be appreciated that it is not necessary to preselect or predetermine a pressure which is the maximum pressure the pump can provide. In fact, it is preferable to select a lower pressure as the first predetermined operating level. Due to the configuration of the pump, as discussed earlier, this pressure will then be provided automatically by the pump output sensing assembly 105 and associated circuitry since the proper mix of liquid and air will occur at that pressure, and no more water will be added. The pump will then partially air bind on a continuous basis, delivering only the desired predetermined pressure output.

It will also be appreciated that the pump output sensing assembly 105 forms a hysteresis loop, since switch 104 normally requires a small amount of travel in each direction before it switches. Assembly 105 can therefore tolerate small fluctuations or surges in the pump output, causing similar oscillation of member 115, without repeatedly opening and closing switch 104. This is desirable since, in practice, minor pressure variations are to be expected, especially where the pressure reduction is being effected by air binding of the pump as a result of a limited water supply.

The pump output sensing assembly 105 also includes normally closed high pressure switch 124 connected in series with the pressure selector switch 100 and the fill valve 120. Switches 100 and 124 are thus in parallel with the low pressure switch 104, providing another control circuit for the fill valve 120. Switch 100 includes a low pressure selector button 126 which opens switch 100, and a high pressure selector button 127 which closes switch 100. When switch 100 is closed, a circuit is completed through the high pressure switch 124 to maintain the fill valve 120 open even after switch 104 is opened by displacement of trip member 115. After switch 104 is thus opened, continued filling is controlled by switch 124 alone.

Continued operation of fill valve 120, of course, will result in less and less air binding of the recirculating pump 45. The pump output and the liquid pressure in the resilient conduit section 107 will therefore continue to increase. The pump output sensing assembly 105 will sense this increased output and will continue to expand against spring 112 until trip member 115 engages and opens the high pressure switch 124. This determines a second predetermined pump output level which is greater than the first level set by the low pressure switch 104, and is a function of spring 112 and the placement or position of the high pressure switch 124 on assembly 105.

In view of the above it will be seen that the manual pressure selector switch 100, in conjunction with its associated circuitry, forms an output selecting means for selectively programming the dishwasher to determine which of the predetermined levels of pump output will be provided. These outputs are sensed by the pump output sensing assembly 105, as indicated, so that switch 100 determines which of switches 104 or 124 will continue to operate the fill valve 120 according to the corresponding predetermined pump output desired. And, as will be further discussed below, it is possible to include appropriate circuitry in timer 95 for selectively changing the above control circuitry during various portions of the dishwashing operation to provide selective control of the fill valve for providing different pressures at different times. For example, it might be desired to have a low pressure prewash followed by a high pressure wash, and these could be programmed into the timer 95 either as a function of, or independently of, the manual pressure selector switch 100.

Figure 24:
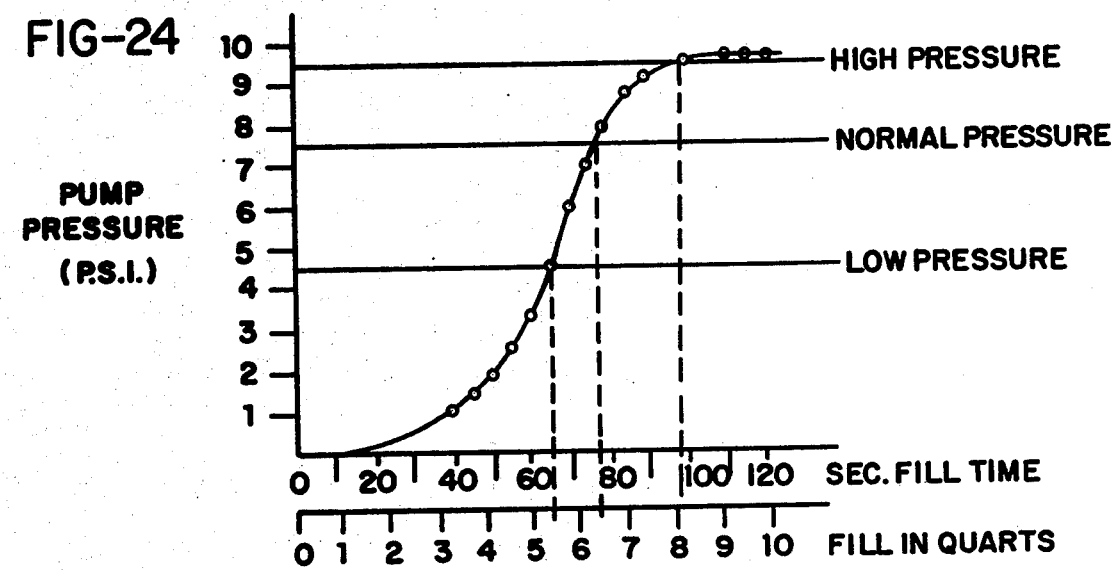
FIG. 24 is a graphical representation of pump pressure as a function of fill quantity in the present invention.

Attention is now invited to FIG. 24, where the pump output pressure is plotted as a function of the quantity of water supplied through the fill valve 120. For reference purposes, a typical time lapse is also plotted, although it should be clear from the foregoing that the pump pressure is a function of the quantity and condition of liquid available, not necessarily of the time the fill valve 120 is open. As may be seen, the pressure approaches its peak rather asymptotically, as would be expected since in the region where the air binding of the pump is terminating, the rate of change in pressure becomes increasingly insensitive to the quantity of liquid available. Thus, if full pressure operation is desired, it may not be practical to adjust the high pressure switch 124 to wait until the last possible moment before interrupting the power to fill valve 120. At such a point the pressure is well beyond the steep part of the curve, and the change in pressure as it reaches the peak may not be sufficient to assure a reliable cutoff of the fill. The high pressure switch 124 should therefore be adjusted to cut off the fill shortly before the pump reaches its full pressure. This thus assures a margin to be certain that the fill will be terminated. (Of course, the dishwasher 30 includes the usual overflow safety float 128, FIG. 1, to terminate the fill if the liquid level becomes too high, and the timer 95 will also eventually terminate the fill.)

Figure 22:
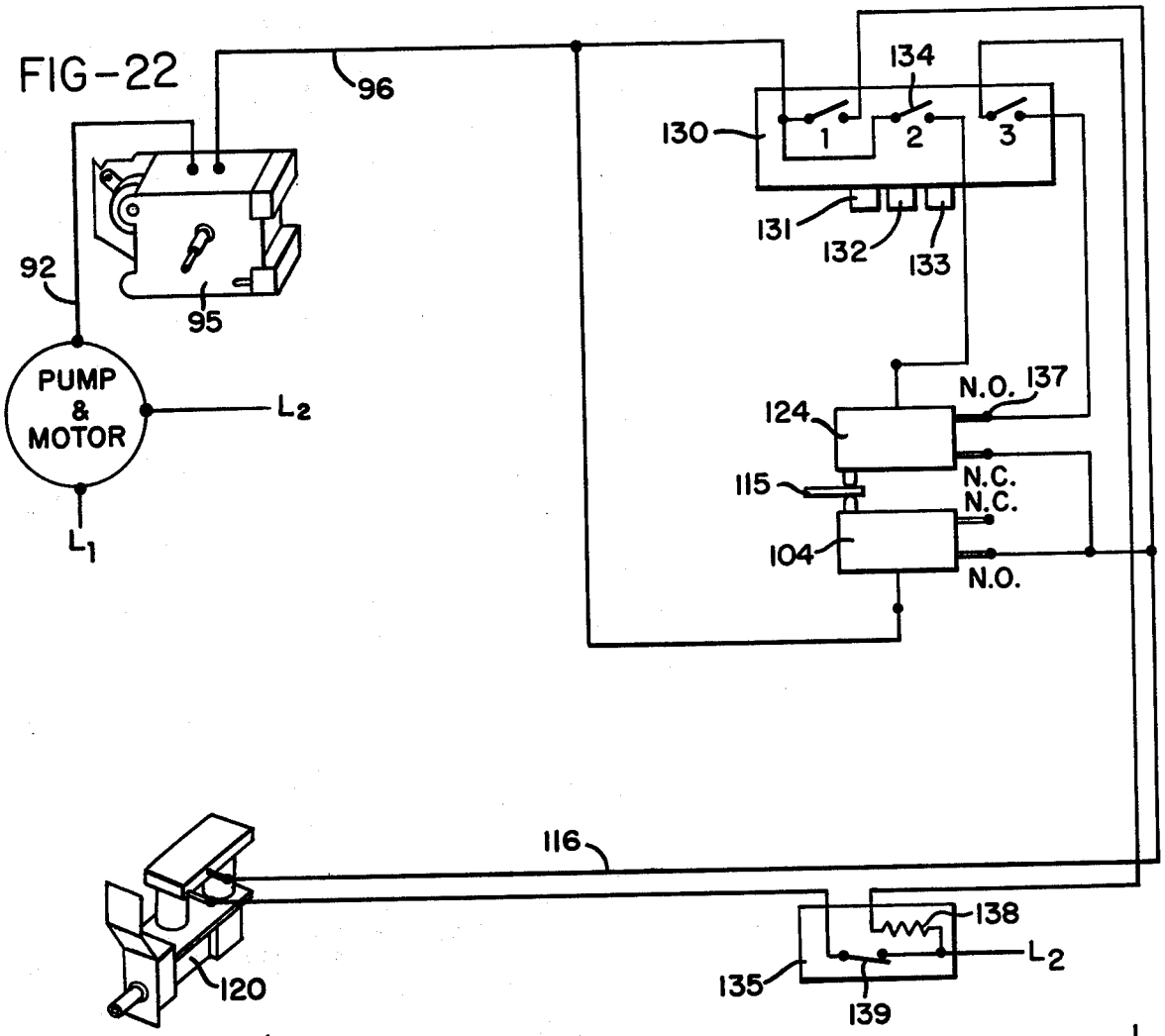
FIG. 22 is an illustration similar to FIG. 17 showing a control and circuit for supplying three predetermined pressures.

FIG. 22 therefore provides an automatic circuit arrangement permitting the selection of three operating pressures, the highest of which may be the full pressure normally available from the recirculating pump. FIG. 24 provides an indication of the three pressures provided by the control circuitry of FIG. 22.

In the FIG. 22 circuit, the low pressure switch 104 is adjusted as in FIG. 17, but the high pressure switch 124 is now adjusted to switch when an intermediate or "normal" pressure is sensed by the pump output sensing assembly 105. The single pole single throw manual pressure selector switch 100 of FIG. 17 is also replaced by a three pole single throw manual pressure selector switch 130, having low, normal, and high pressure selector buttons 131-133. When the low pressure selector button 131 is depressed, all three of the switches in switch 130 are open, and the low pressure switch 104 controls the fill valve 120 as previously described. When the normal pressure selector button 132 is depressed, middle switch 134 is switch 130 is closed, forming a parallel control circuit through switch 124 and around switch 104, also as previously described, to maintain fill until the normal pressure is reached.

When high pressure operation is desired, the high pressure selector button 133 is depressed, closing all threee of the switches in the manual pressure selector switch 130 and completing a circuit to fill valve 120 around both switches 104 and 124. This also places a thermal delay timer 135 in series with the normally open contact 137 of switch 124. When switch 124 is then actuated at the normal pump output pressure, it supplies power to the heater 138 of the thermal delay timer 135. This causes the thermal delay timer 135 to start timing its period, at the conclusion of which the thermal delay timer switch 139 opens to interrupt the circuit for the fill valve 120, thus terminating the fill. Of course, the time delay of timer 135 is selected to introduce sufficient water to carry the pressure up to the top of the curve, as illustrated in FIG. 24.

Figure 23:
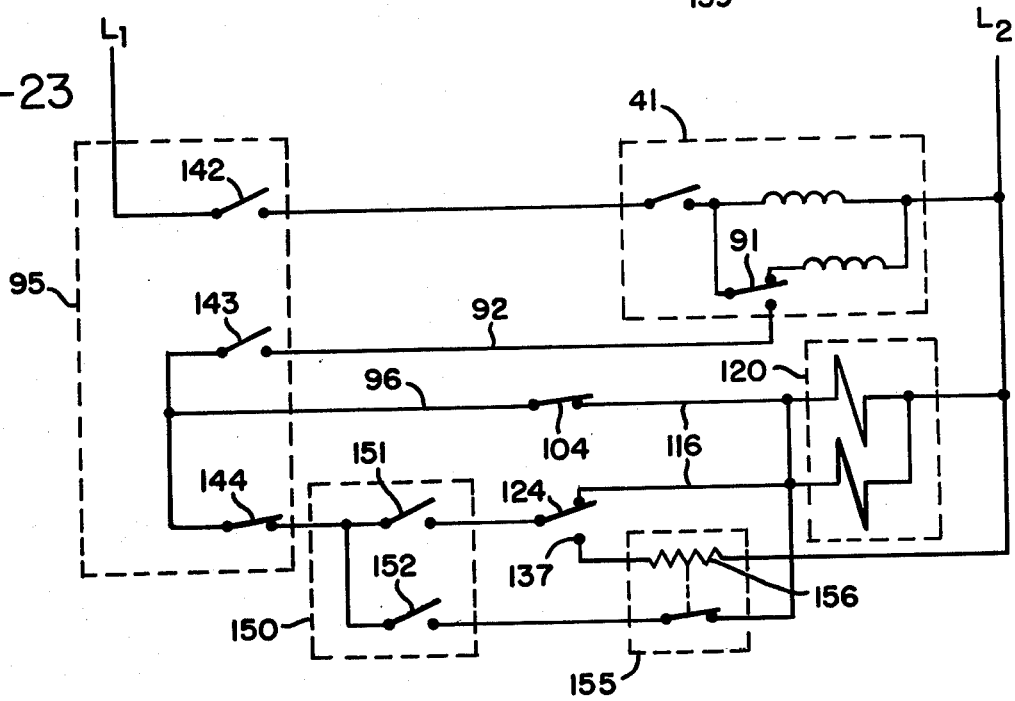
FIG. 23 is a schematic illustration of another circuit arrangement similar to FIG. 22.

FIG. 23 illustrates another three pressure control circuit similar to that of FIG. 22. In this circuit, the timer 95 operates interior switches 142–144, and a new manual pressure selector switch 150 is provided having three selector buttons (not shown) similar to those of switch 130 in FIG. 22. When the low pressure selector button of switch 150 is selected, the two switches 151 and 152 in switch 150 are open. When the normal pressure selector button is selected, the normal pressure switch 151 is closed. The high pressure selector button closes both the normal pressure and high pressure switches 151 and 152.

Operation of the dishwasher according to FIG. 23 then proceeds as follows. Timer 95 first closes its motor control switch 142 to energize the recirculating pump motor 41. When motor 41 is operating it completes a circuit through the motor starting coil switch 91 to the timer fill control switch 143. When the timer calls for the dishwasher to fill, the timer closes the fill control switch 143 to supply power to the fill valve 120 through the low pressure switch 104. Bearing in mind at this point that a normal wash cycle may include seven or more fills, several of them may require only a low pressure fill, as previously mentioned. If the particular fill is to be low pressure, the timer keeps its timer controlled pressure selector switch 144 open, removing the manual pressure selector switch 145 from the fill control circuit. A low pressure fill is then provided.

If the particular fill is one which may be a normal or high pressure fill, if so desired by the machine operator, then the timer closes switch 144 to permit the manual pressure selector switch 150 to continue the fill for a higher pressure. If the normal pressure selector button has been depressed, then the normal pressure switch 151 will permit the high pressure switch 124 to continue the fill to the normal pressure. If the high pressure selector button has been depressed, the thermal delay timer 155 will receive power through the high pressure switch 152 to hold the fill valve 120 open until switch 124 energizes the thermal delay timer heater 156 through normally open switch contact 137. When heater 156 is energized, the delay period will time out and then open the delay timer 155 to terminate the fill.

The circuit in FIG. 23 thus includes an additional capability over the preceding circuits. In FIG. 23, the timer controlled pressure selector switch 144 provides a means for selectively changing the programming of the dishwasher pressure control (which includes the manual pressure selector switch 150) during operation of the dishwasher. Switch 144 makes it possible automatically to provide selective control of the fill means according to the corresponding pump outputs preselected for use during various operations of the dishwasher. In other words, the timer may override the manual pressure selector switch 150 to provide a different pressure at certain portions of the washing cycle.

Figure 25:
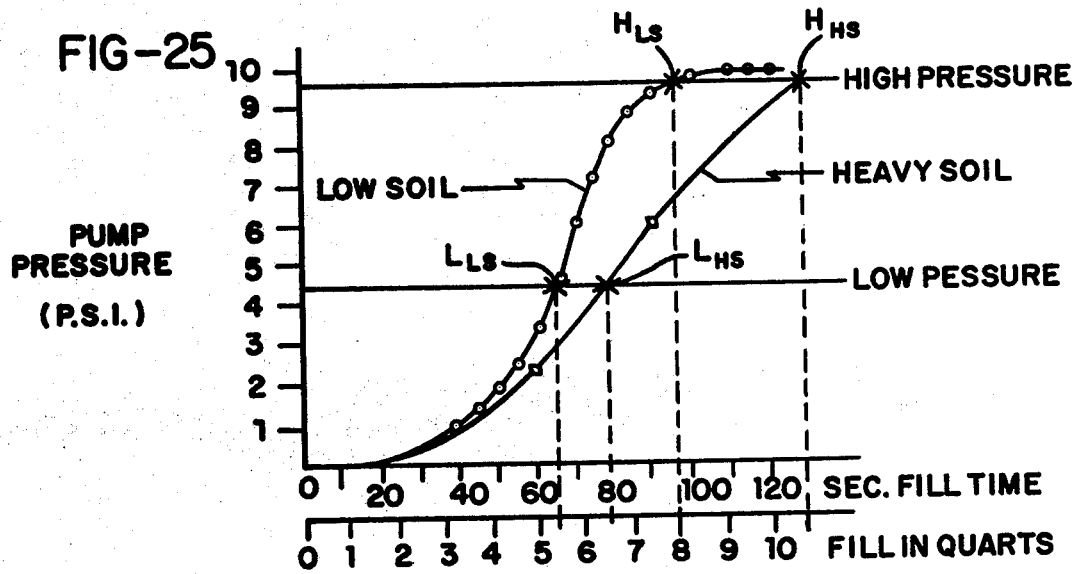
FIG. 25 illustrates the effect of food soil on the pump output.

Attention is now invited to FIG. 25 which presents typical pressure curves for low soil and heavy soil fills. When there is only a small amount of soil present in the dishwasher, there is little development of suds, so the desired pressure is reached with a minimum of water. On the other hand, large amounts of soil, especially if proteinaceous in nature, will produce large amounts of suds, thus requiring considerably more water to achieve the desired pump output. The present invention automatically supplies the exact amount of water necessary to achieve the desired pressure, as explained previously.

FIG. 25 also demonstrates the savings which are possible with the present invention, since under a low soil condition substantially less water will be used than would be the case with conventional washing machines. When these savings are multiplied by seven or more fills of hot water for a typical washing operation, the potential savings can readily be appreciated.

Figure 26:
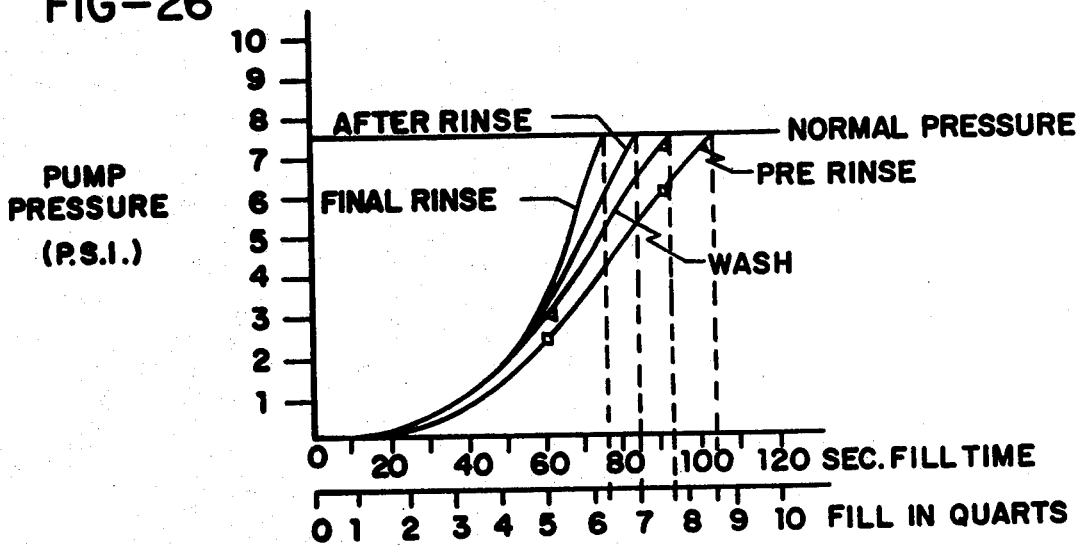
FIG. 26 demonstrates the fill and pressure conditions of a typical wash cycle.

FIG. 26 illustrates a typical wash cycle of soiled articles conducted at normal pressure. Only the first, third, fifth, and seventh fills have been illustrated, it being understood that the intermediate fills will fall with these curves. During the prerinse, the very heavy soil develops considerable foam, requiring a large amount of water to achieve the normal pressure. Less water is required during the wash cycle since the amount of soil in the solution is reduced. The decrease continues during the after rinse, and reaches minimum consumption in the final rinse where the water is essentially clean. Thus the present invention automatically changes the fill during the course of the washing operation in response to the increasing cleanliness of the dishes. Only the amount of water is drawn which is required, and no more.

As may be seen, therefore, the present invention provides numerous advantages. As indicated, the amount of water and energy consumed is substantially less than that of conventional machines. Furthermore, it is now possible to provide different levels or pressures of operation as a function of the output which is developed by the recirculating pump. Exactly the desired output is provided regardless of the type of load in the dishwasher, and without requiring an excessive fill. It is also possible, as indicated, to recirculate the liquid within the dishwasher at one pressure during at least one designated dishwasher period, and at a second pressure during another designated period, to provide different pressures during the automatic cycle of the dishwasher.

In the preferred embodiment of the present invention, as has been illustrated, the pump output is sensed by measuring the pump output pressure which appears in the resilient conduit section 107. Other ways of measuring the pump output may also be employed within the scope of the present invention. For example, the pressure may be sensed by any conventional pressure switch connected into the liquid circuit of the pump output. The velocity of liquid flow in the pump output liquid circuit may be measured as an indication of the pump output. Where movable spray arms, such as the rotating lower spray arm 38 are used, the velocity or rates of revolution may be measured to provide an indication of the pump output. Likewise, the momentum of the water being recirculated may be measured such as by using a conical tube flow meter or impinging a spray jet on an appropriate spring biased switch. The power consumed by the recirculating pump motor 41 provides still another indication of the pump output so that the motor amperage and/or wattage may be measured, and this measure used for sensing and indicating the output developed by the recirculating pump. Likewise, the velocity of the motor, if nonsynchronous, may be used as a measure. Still another means would include a mechanical drive, such as a piston, which would be actuated by the pump output to close a mechanical fill valve (e.g., a "pinch" valve) when the desired pressure was reached.

Turning again to FIG. 26, it may be seen that the family of the curves is a function of the cleanliness of the dishes. It is therefore conceivable that the pump output sensing means could be connected to a circuit to take the first derivative of the pump output, during fill, as a measure of the cleanliness of the dishes. This data could then be used to shorten or lengthen the total washing cycle as a function of whether or not the dishes were clean. Unnecessary fill cycles could be eliminated or additional cycles could be added according to the cleanliness of the dishes, as measured by this rate of change in the pressure during the fill cycle.

While the forms of apparatus herein described constitute preferred embodiments of this invention, it is to be understood that the invention is not limited to these precise forms of apparatus, and that changes may be made therein without departing from the scope of the invention.

What is claimed is:

1. A fill control for an automatic dishwasher having a tank, a cycle control, a liquid recirculating system including a recirculating pump controlled by the cycle control and having an inlet and an outlet, means at the bottom of the dishwasher tank for containing a pool of liquid in the vicinity of the pump inlet, and fill means and drain means controlled by the cycle control for repeatedly introducing liquid into the dishwasher tank and draining the same at predetermined fill and drain periods during the course of washing a load of dishes, the recirculating pump being operated during at least the latter part of each fill period, comprising:

(a) pump output sensing means for sensing the amount of output developed by the recirculating pump during each fill period, and (b) fill regulating means connected to the cycle control and to the fill means, for operating the fill means to introduce liquid into the dishwasher during each predetermined fill period, said fill regulating means incorporating said pump output sensing means and continuing to operate the fill means during each fill period as long as said pump output sensing means senses an output below a first predetermined output, said first predetermined output being a reduced output which is caused by simultaneous aspiration of liquid and air into the pump inlet and is less than the maximum output of which the recirculating pump is capable, to introduce sufficient liquid into the dishwasher to partially close the pump intake by the liquid to cause the recirculating pump to aspirate the proper ratio of liquid and air through the intake to develop said reduced output with only the minimum quantity of liquid needed therefor according to the size, the nature of the soil, and other conditions of the particular load of dishes present at the time of each particular fill period, said fill regulating means thus ordinarily varying the quantity of liquid introduced from one fill period to the next during the course of washing a load of dishes.

2. The fill control of claim 1 wherein said pump output sensing means senses the pressure developed by the recirculating pump.

3. The fill control of claim 1 wherein said fill regulating means further comprises means for continuing to operate the fill means during at least one of the predetermined fill periods to continue introducing liquid into the dishwasher as long as said pump output sensing means senses an output below a second predetermined output which is greater than said first predetermined output and also less than the maximum output of which the recirculating pump is capable.

4. The fill control of claim 3 further comprising pump output selecting means for selectively programming said fill regulating means to determine which of said predetermined pump outputs, as sensed by said pump output sensing means, shall be sensed to cause said fill regulating means to continue to operate the fill means when the pump output is below the selected predetermined output.

5. The fill control of claim 4 wherein said pump output selecting means includes means for selectively changing the programming of said fill regulating means during the operation of the automatic dishwasher to provide selective control of the fill means at each fill period according to the corresponding predetermined pump outputs selected during operation of the dishwasher.

6. The fill control of claim 1 further comprising delay means controlled by said fill regulating means for continuing to operate the fill means to introduce liquid into the dishwasher during a predetermined delay period after said pump output sensing means senses said predetermined reduced pump output.

7. The fill control of claim 1 wherein the pump inlet faces downwardly toward the bottom of the tank to reduce the likelihood of surging in the liquid recirculating system as liquid enters the pump inlet.

8. A fill control for an automatic dishwasher having a tank, a cycle control, a liquid recirculating system including a recirculating pump controlled by the cycle control and having an inlet and an outlet, means at the bottom of the dishwasher tank for containing a pool of liquid in the vicinity of the pump inlet for recirculation within the dishwasher by the liquid recirculating system, a spray member for spraying the recirculated liquid within the tank, a liquid conduit connecting the outlet of the recirculating pump to the spray member, and fill means and drain means controlled by the cycle control for repeatedly introducing liquid into the dishwasher tank and draining the same at predetermined fill and drain periods during the course of washing a load of dishes, the recirculating pump being operated during at least the latter part of each fill period, comprising:

(a) sensing means associated with the liquid conduit for sensing the amount of output developed by the recirculating pump during each fill period, and (b) fill regulating means connected to the cycle control and the fill means for operating the fill means to introduce liquid into the dishwasher during each predetermined fill period, said fill regulating means incorporating said sensing means and continuing to operate the fill means during each fill period as long as said sensing means senses a pump output below a first predetermined output, said first predetermined output being a reduced output which is caused by simultaneous aspiration of liquid and air into the pump inlet and is less than the maximum output of which the recirculating pump is capable, to introduce sufficient liquid into the dishwasher to partially close the pump intake by the liquid to cause the recirculating pump to aspirate the proper ratio of liquid and air through the intake to develop said reduced output with only the minimum quantity of liquid needed therefor according to the size, the nature of the soil, and other conditions of the particular load of dishes present at the time of each particular fill period, said fill regulating means thus ordinarily varying the quantity of liquid introduced from one fill period to the next during the course of washing a load of dishes.

9. The fill control of claim 8 wherein said sensing means associated with the liquid conduit comprises:

(a) a resilient conduit section flexibly responsive to the pressure of the recirculatng liquid therewithin, (b) resilient clamp means engaging said resilient conduit section for compressing said section against the liquid pressure therein, and (c) electrical means responsive to expansion of said resilient conduit section and clamp to provide a signal when said conduit and clamp expand to an extent corresponding to said first predetermined pump output.

10. The fill control of claim 9 wherein said electrical means includes means responsive to expansion of said resilient conduit section and clamp to provide an additional signal when said conduit and clamp expand to an extent corresponding to a second predetermined pump output which is greater than said first predetermined output and less than the maximum output of which the recirculating pump is capable.

11. The fill control of claim 9 wherein said clamp means further comprises a trip member which is displaced in response to expansion of said clamp, and wherein said electrical means includes a switch which is actuated by movement of said trip member to provide said signal.

12. A fill control for an automatic dishwasher having a tank, a cycle control, a liquid recirculating system including a recirculating pump controlled by the cycle control and having an inlet and an outlet, means at the bottom of the dishwasher tank for containing a pool of liquid in the vicinity of the pump inlet for recirculation within the dishwasher by the liquid recirculating system, a spray member for spraying the recirculating liquid within the tank, a liquid conduit connecting the outlet of the recirculating pump to the spray member, and fill means and drain means controlled by the cycle control for repeatedly introducing liquid into the dishwasher tank and draining the same at predetermined fill and drain periods during the course of washing a load of dishes, the recirculating pump being operated during at least the latter part of each fill period, comprising:

(a) means on the pump inlet facing the inlet downwardly toward the bottom of the tank to control the formation of vortices and the aspiration of air into the liquid as it enters the pump inlet to reduce the likelihood of surging in the liquid recirculating system, (b) a resilient conduit section forming a portion of the liquid conduit, said resilient conduit section being flexibly responsive to the pressure of the recirculated liquid therewithin, (c) resilient clamp means engaged about said resilient conduit section for compressing said section against the liquid pressure therein, (d) a trip member on said clamp means, said trip member being movable in response to expansion of said clamp and resilient conduit when the pressure of the recirculating liquid increases within said resilient conduit section, (e) a first electrical switch located adjacent said trip member, (f) said trip member and said switch being operatively adjusted to operate said switch upon movement of said trip member to a position corresponding to a first predetermined pump output which is a reduced output which is less than the maximum output of which the recirculating pump is capable, (g) fill regulating means connected to the cycle control and the fill means for operating the fill means to introduce liquid into the dishwasher during each predetermined fill period, said fill regulating means connecting said electrical switch to the dishwasher fill means for operating the fill means and continuing to introduce liquid into the dishwasher during each fill period and at least until said switch is operated by said trip member, said switch and fill regulating means thus controlling the dishwasher fill means to introduce sufficient liquid into the dishwasher to cause the recirculating pump to aspirate the proper ratio of liquid and air through its inlet to develop said first predetermined reduced output with only the minimum quantity of liquid needed therefor according to the size, the nature of the soil, and other conditions of each particular fill period, said fill regulating means thus ordinarily varying the quantity of liquid introduced from one fill period to the next during the course of washing a load of dishes, (h) a second switch similar to said first switch, said second switch being located adjacent said trip member for operating said second switch when said conduit and clamp expand to an extent corresponding to a second predetermined pump output which is greater than said first predetermined output and less than the maximum output of which the recirculating pump is capable, (i) time delay switch means energizable by said second switch when operated by said trip member upon expansion of said conduit and clamp, (j) pump output selecting means for selectively determining which of said first switch, second switch, and time delay switch means will be operatively connected by said fill regulating means to the fill means for control thereof for introducing liquid into the dishwasher tank, and (k) said pump output selecting means including means for selecting another of said first, second, and time delay switch means during the operation of the automatic dishwasher to provide selective control of the fill means according to the particular switch means selected.

13. A method of washing dishes in an automatic dishwasher providing an automatic cycle having several time periods in each of which liquid is introduced into, recirculated within, and then drained from the dishwasher for washing and rinsing a load of dishes contained therein, comprising:

(a) introducing liquid into the dishwasher at the beginning of each such time period, (b) recirculating the liquid by means of a recirculating pump as the liquid is being introduced into the dishwasher, (c) sensing the amount of output of the recirculating pump, and (d) continuing to introduce the liquid into the dishwasher while the sensed output is below the predetermined output which is less than the maximum output of which the recirculating pump is capable, to introduce only the minimum quantity of liquid needed to partially close the pump intake to cause the recirculating pump to aspirate the proper ratio of liquid and air into its input to cause the pump to develop the predetermined output, the quantity of liquid being a function of the size, the nature of the soil, and other conditions of the particular load of dishes present at the beginning of each time period, and ordinarily varying from one time period to the next during the course of washing a load of dishes.

14. The method of claim 13 wherein the sensed output is the pressure of the liquid at a predetermined location as it is being recirculated.

15. A method of washing dishes in an automatic dishwasher providing an automatic cycle having several time periods in each of which liquid is introduced into, recirculated within, and then drained from the dishwasher for washing and rinsing a load of dishes contained therein, comprising:

(a) sensing the pressure of the liquid at a predetermined location as it is being recirculated within the dishwasher, (b) introducing the liquid into the dishwasher at the start of at least one designated period as long as the sensed pressure is below a first pressure to introduce sufficient liquid into the dishwasher to cause the same to develop the first pressure with as little liquid as needed therefor, (c) recirculating the liquid within the dishwasher at the first pressure during this designated dishwasher period, and (d) recirculating the liquid within the dishwasher at a second pressure different from the first pressure during a subsequent designated dishwasher period to provide different recirculation pressures during certain periods of the automatic cycle of the automatic dishwasher.

16. The method of claim 15 wherein step d) further comprises:

(a) sensing the pressure of liquid at a predetermined location as it is being recirculated within the dishwasher, and (b) introducing the liquid into the dishwasher at the start of the subsequent designated period as long as the sensed pressure is below the second pressure to introduce sufficient liquid into the dishwasher to cause the same to develop the second pressure with as little liquid as needed therefor.

* * * * *